United States Patent [19]

Ito

[11] Patent Number: 4,949,131

[45] Date of Patent: Aug. 14, 1990

[54] FIXING APPARATUS

[75] Inventor: Masazumi Ito, Osaka, Japan

[73] Assignee: Minolta Camera Kabushiki Kaisha, Osaka, Japan

[21] Appl. No.: 210,017

[22] Filed: Jun. 22, 1988

[30] Foreign Application Priority Data

Jun. 24, 1987 [JP] Japan ..... 62-156782

[51] Int. Cl.[5] ..... G03G 15/20; G03G 21/00

[52] U.S. Cl. ..... 355/282; 355/285; 355/208

[58] Field of Search ..... 355/204, 208, 282, 284, 355/285, 295; 219/469, 243; 323/369; 148/402

[56] References Cited

U.S. PATENT DOCUMENTS

| | | | |
|---|---|---|---|
| 3,888,622 | 6/1975 | Thettu | 355/285 |
| 4,385,826 | 5/1983 | Itoh | 355/295 |
| 4,687,315 | 8/1987 | Fujii | 355/285 |

FOREIGN PATENT DOCUMENTS

| | | | |
|---|---|---|---|
| 59-189659 | 12/1984 | Japan . | |
| 60-23872 | 2/1985 | Japan . | |
| 0047680 | 3/1987 | Japan | 355/208 |
| 0294274 | 12/1987 | Japan | 355/285 |
| 0095485 | 4/1988 | Japan | 355/208 |

*Primary Examiner*—A. T. Grimley
*Assistant Examiner*—Nestor R. Ramirez
*Attorney, Agent, or Firm*—Wenderoth, Lind & Ponack

[57] ABSTRACT

A fixing apparatus has a heat roller having a heater, a pressure roller contacting the heat roller under pressure, a drive for rotating the heat roller, a temperature detecting element for detecting a temperature of the heat roller, a holder holding the temperature detecting element so that the element is maintained in a non-contact state with the heat roller at a specified temperature or less and so that the element is maintained in a contacting state with the heat roller over the specified temperature, and a controller for starting the carrying out of a rotation of the heat roller when it is detected that the temperature detecting element contacts the heat roller.

6 Claims, 4 Drawing Sheets

FIXING APPARATUS

BACKGROUND OF THE INVENTION

The present invention generally relates to a fixing apparatus for use in an image forming apparatus such as a copy machine or a printer.

Conventionally, as one example of a fixing apparatus as referred to above, there has been proposed, for example, in U.S. Pat. No. 4,385,826, an arrangement which includes a heat roller having a heater and a pressure roller contacting the heat roller under pressure so that toner of a unfixed toner image held on a sheet is melted and fixed on the sheet while the sheet is held by the heat roller and the pressure roller while being transported thereby.

The apparatus generally comprises a temperature detecting element so as to detect the temperature state of the heat roller to control the heater. For prevention of a defective fixing of a copy paper, after the heater turns on, when the element detects that the temperature of the heat roller reaches a specified fixing, pre-rotation start temperature, the heat roller is driven to rotate so as to transmit the heat thereof to the pressure roller and so as to sufficiently heat the toner from both sides of the sheet.

In the conventional fixing apparatus, however, since the temperature detecting element always contacts the heat roller under pressure, there have been involved such problems that the contact portion, contacting the temperature detecting element, of the heat roller is greatly damaged and thus the longevity of the heat roller is reduced.

Furthermore, an essential object of the temperature detecting element is to control the heater in order to maintain the temperature of the heat roller and the pressure roller in the toner fixing operation state. In accomplishing the object, the temperature region of the temperature detecting element should be a comparative narrow region. However, in the above apparatus, the temperature region of the temperature detecting element to detect the temperature thereof is required to be wide region i.e. from a low temperature to a high temperature, for detecting the specified fixing pre-rotation start temperature.

SUMMARY OF THE INVENTION

Accordingly, an essential object of the present invention is to provide a fixing apparatus in which the damage to the heat roller can be reduced and which can provide good longevity of the heat roller.

Another object of the present invention is to provide a fixing apparatus which can accurately maintain the temperature of the heat roller and the pressure roller maintain in the fixing operation state.

In accomplishing this and other objects, there is provided a fixing apparatus comprising a heat roller having a heater; a pressure roller contacting said heat roller under pressure; drive means for rotating said heat roller; a temperature detecting element for detecting a temperature of said heat roller; a holder holding said temperature detecting element to maintain said element out of contact with said heat roller when said heat roller is at a specified temperature or less and to maintain said element in a contact with said heat roller when said heat roller is above the specified temperature; detecting means for detecting that said temperature detecting element contacts said heat roller; and control means for starting rotation of said heat roller om response to a signal from said detecting means.

BRIEF DESCRIPTION OF THE DRAWINGS

These and other objects and features of the present invention will become apparent from the following description of a preferred embodiment thereof taken in conjunction with the accompanying drawings, in which.

DETAILED DESCRIPTION OF THE INVENTION

Figure 1:
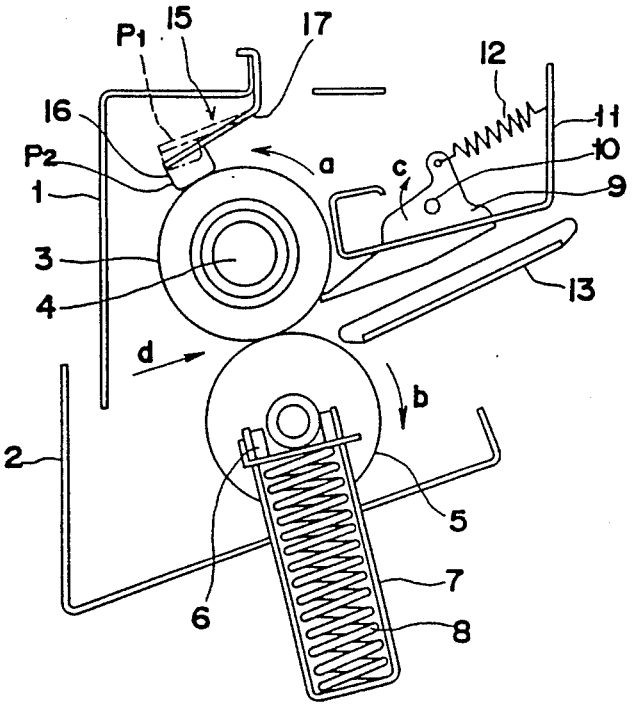
FIG. 1 is a cross-section view of a fixing apparatus according to one preferred embodiment of the present invention.

Before the description of the present invention proceeds, it is to be noted that like parts are designated by like reference numerals and symbols throughout the accompanying drawings.

Referring now to the drawings, FIG. 1 illustrates a fixing apparatus such as a fine particle developing type of a copying machine or a printer. In FIG. 1, numeral 1 and 2 are designated casings. A heat roller 3 and a pressure roller 5 are held in the space surrounded by the casings 1 and 2.

The heat roller 3 has a heater at the center thereof. The two ends of the pressure roller 5 are supported by bearings 6 and the pressure roller 5 is contacted with the heat roller 3 under pressure by a bias force of a spring 8 arranged in a holder 7. One bearing 6 is not shown in the drawings.

In FIG. 1, a separation claw 9 is arranged at the right side of the heat roller 3 so as to be capable of rotating around a supporting shaft 10. The one end of a spring 12 is connected to a frame 11 and the other end thereof is connected to the claw 9. Thus, the claw 9 is urged by a bias force of the spring 12 in the direction shown by an arrow (c) so that the end of the separation claw 9 is contacted with the outer circumferential portion of the heat roller 3 under pressure.

A temperature detecting apparatus 15 comprises a thermistor temperature element 16 (referred to as a "thermistor" hereinafter), serving as a temperature detecting element, and a holder 17 fixed to the casing 1 for holding the thermistor 16 at the upper portion of the heat roller 3.

The holder 17 is made of shape-memory alloys having such a shape-memory effect such that the shape thereof returns to an original shape when the temperature thereof reaches a specified martensite transformation temperature (referred to as "a memory temperature" hereinafter) $T_2'$. Accordingly, when the temperature of the holder 17 is the memory temperature $T_2'$ or less, the thermistor 16 is maintained in the first state $P_1$ separated from the heat roller as shown by the dark line in FIG. 1. When the temperature of the holder 17 is above the memory temperature $T_2'$, as shown by the solid line in FIG. 1, the thermistor 16 is maintained in the second state $P_2$ contacting with the surface of the heat roller 3 under pressure.

The memory temperature $T_2'$ is set at such a specified temperature corresponding to the necessary temperature for starting the rotation of the heat roller 3 so as to transmit the heat of the heat roller 3 heated by the heater 4 to the pressure roller 5, that is, a fixing pre-rotation start temperature $T_2$. Namely, when the temperature of the holder 17 reaches the memory temperature $T_2'$, the temperature of the heat roller 3 becomes a specified fixing pre-rotation start temperature $T_2$.

Figure 2:
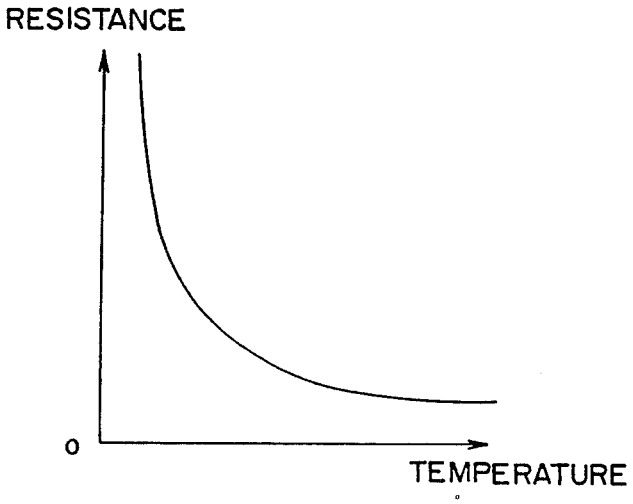
FIG. 2 is a graph showing a characteristic of a resistance of a thermistor and a temperature thereof in the fixing apparatus.
Figure 6:
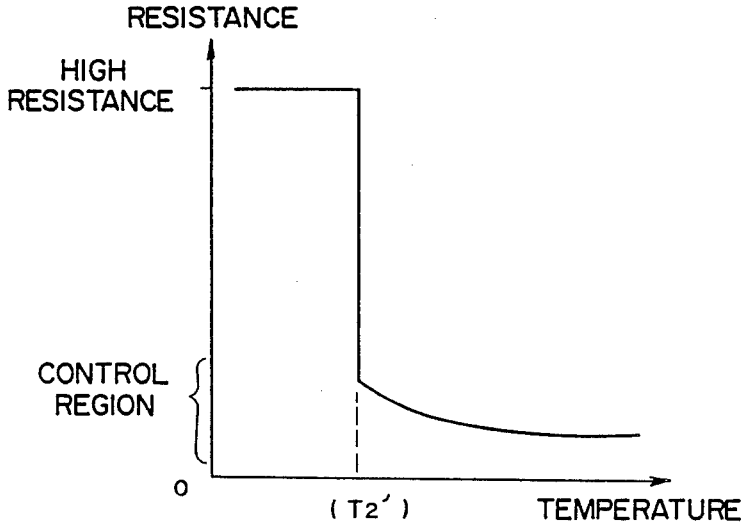
FIG. 6 is a graph showing a resistance change of the thermistor in the fixing apparatus.

The thermistor 16 has a negative characteristic shown in FIG. 2, that is, the resistance value of the thermistor 16 falls with respect to a temperature rise thereof. As shown in FIG. 6, in the thermistor 16, a high resistance state is maintained in the non-contact state with respect to the heat roller 3, and the resistance value thereof is greatly reduced as soon as the thermistor 16 contacts the heat roller 3 in a temperature rise state of the heat roller 3, thus arriving in a control region.

Next, a control circuit of the fixing apparatus will be described.

Figure 3:
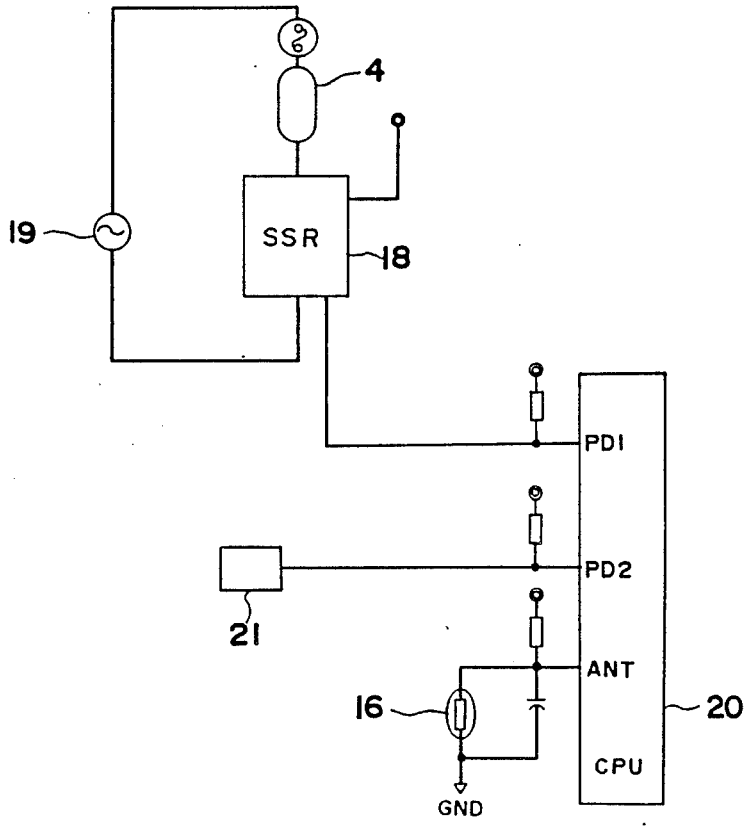
FIG. 3 is a control circuit diagram thereof.

In FIG. 3, the thermistor 16 is connected to a terminal (ANT) of a CPU (central processing unit) 20, and a terminal (PD1) of the CPU 20 is connected to a solid-state relay (referred to as a "relay" hereinafter) 18, so that an on-off control of the relay 18 is carried out by the CPU 20 according to an input signal generated from the thermistor 16 so as either to connect the heater 4 to the power source 19 or so as not to connect it to the power source 19. A terminal PD2 of the CPU 20 is connected to a drive circuit 21 for rotating the heat roller 3.

Figure 4:
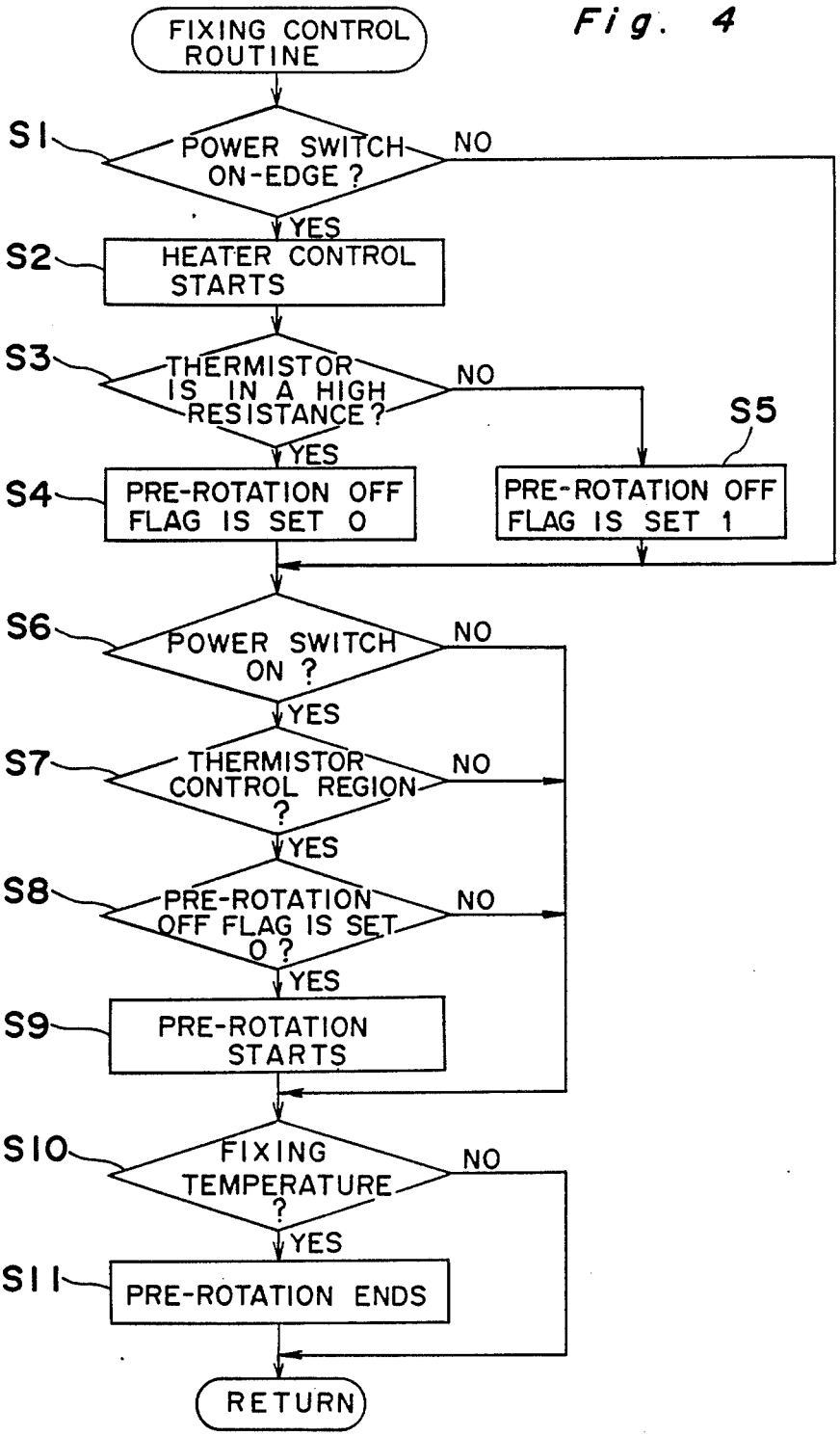
FIG. 4 is a flow-chart of a fixing control routine of the fixing apparatus.

Hereinafter, the operation of the fixing apparatus will be explained by referring to a flow-chart of a toner fixing control subroutine shown in FIG. 4. The fixing control subroutine can be repeatedly carried out in each minute period of an internal timer which is set by a control apparatus (not shown).

Figure 5:
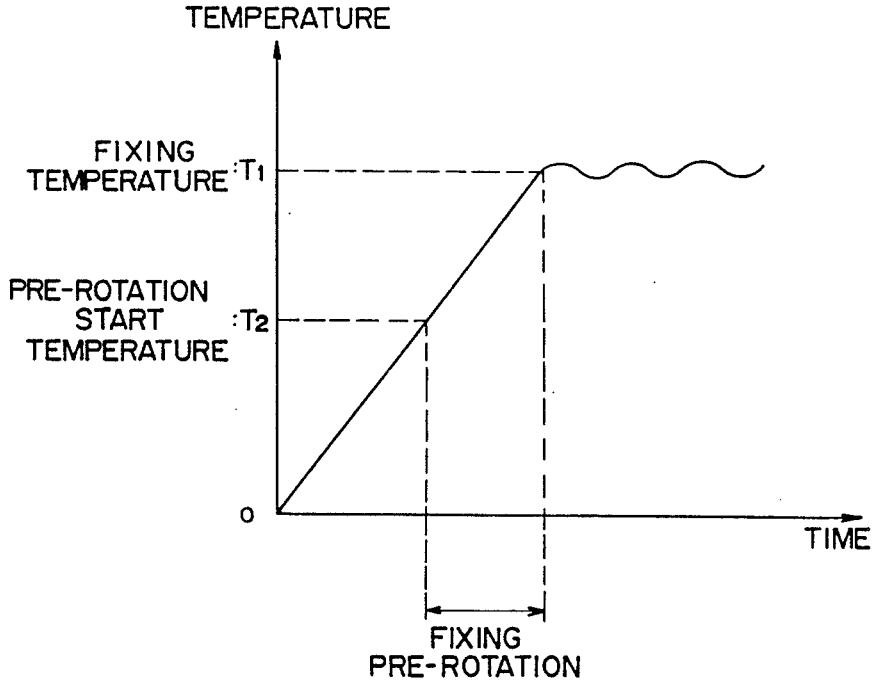
FIG. 5 is a graph showing a characteristic of a temperature of a heat roller and a time in the fixing apparatus.

When a power switch of a copy machine is turned on and an on-edge of the power switch is detected at step S1, the relay 18 turns on according to a signal generated from the CPU 20 and power is supplied from the power source 19 to the heater 4. Thus, the heat roller 3 is gradually heated by the heater 4, the temperature thereof rises as shown in FIG. 5, and the temperature of the holder 17 rises by the thermal effect of the heat roller 3. The "on-edge" is defined as a change of state where a switch state changes from an OFF state to an ON state.

Next, at step S3, it is judged whether or not the thermistor 16 is in a high resistance. For example, in the case where the copy machine stops operating for several hours and the power switch of the copy machine body turns on, since the thermistor 16 is in a high resistance state at that time when the on-edge of the power switch is detected, a pre-rotation off flag is set 0-at next step S4. In the case where the power switch is turned on very shortly after as the switch is turned off, the procedure proceeds the step S5 and the prerotation off flag is set 1 since the value of the thermistor 16 is within a control region in contact with the heat roller 3.

At step S6, it is judged whether or not the switch of the copier is on state. In a first routine thereof where the switch of the body is turned on, the procedure proceeds to step S6 through either steps S1–S4 or steps S1–S5. In the next routine thereof, after the on-edge of the power switch is detected, the procedure directly jumps from the step S1 to step S6.

At step S7, it is judged whether or not the thermistor 16 is within the control region.

Since the temperature of the heat roller 3 does not sufficiently rise right after the power switch of the body turns on, the temperature of the holder 17 does not reach the memory temperature $T_2'$ so that the holder 17 is maintained in the first state $P_1$ shown by the dotted line. Since the thermistor 16 is maintained in the non-contact state with the heat roller 3, the resistance value thereof is a high resistance and the procedure returns through step S10.

Thereafter, the heat roller 3 and the holder 17 are heated further and the temperature of the holder 17 reaches the memory temperature $T_2'$. Thus, the state of the holder 17 changes from the first state $P_1$ into the second state $P_2$ by the martensite transformation thereof and the thermistor 16 contacts the surface of the heat roller 3.

As a result, the resistance value of the thermistor 16 is greatly reduced as shown in FIG. 6 and is within the control region. Then, if such a state is detected at step S7, it is judged whether or not the prerotation off flag is 0 at step S8.

If the pre-rotation off flag is 0, namely, if such a state exists that the thermistor 16 firstly contacts the heat roller 3 after the on-edge of the power switch is detected, the pre-rotation of the heat roller 3 starts at step S9.

On the other hand, if the pre-rotation off flag is 1, i.e., in the state in which the value of the thermistor 16 in contact with the heat roller 3 is within the control region when the on-edge of the power switch is detected, the procedure proceeds to step 10 without the fixing prerotation.

Next, at step S10, it is judged whether or not the temperature of the heat roller 3 has reached the fixing temperature $T_1$ according to the information generated from the thermistor 16, as shown in FIG. 5. If the temperature thereof is the fixing temperature $T_1$ or less, the procedure returns to continue carrying out the fixing pre-rotation of the heat roller 3. If the temperature thereof is over the fixing temperature $T_1$, the procedure proceeds to step S11 and stops carrying out the fixing pre-rotation. Then, the temperature control of the heat roller 3 toward the fixing temperature $T_1$ is carried out according to the information generated from the thermistor 16.

In the state where the above-described temperature control is carried out, the fixing becomes possible. Thus, the sheet holding an unfixed toner image on the upper surface thereof is transported in the direction shown by an arrow d. While the sheet is held and transported by the heat roller 3 and the pressure roller 5, the toner image thereof is melted and fixed thereon.

The sheet on which the toner image is fixed is separated from the surface of the heat roller 3 by the separation claw 9 and is discharged to a discharge portion (not shown) along a guide plate 13.

Part of toner offset on the heat roller 3 during the above fixing operation is accumulated at the upstream side of the thermistor 16. However, while the temperature control of the heat roller 3 is carried out, the toner is soft enough to prevent damage to the surface of the heat roller 3.

When the power switch of the body turns is turned off and the temperature of the holder is the memory temperature $T_2'$ or less, the state of the holder 17 changes the second state $P_2$ into the first state $P_1$. Furthermore, when the temperature thereof reaches normal temperature, the toner accumulated on the thermistor 16 cools down to and solidifies.

Then, when the surface temperature of the heat roller 3 rises after the power switch of the body turns on again, the toner on the thermistor 16 is softened according to the temperature rise thereof by the heat effect of the heat roller 3.

Thus, when the state of the holder 17 changes into the second state $P_2$ so that the thermistor 16 contacts the surface of the heat roller 3 under pressure, the toner is already softened at that time. Accordingly, no damage to the surface of the heat roller 3 is caused by the toner.

As is clear from the above-described operation, in the fixing apparatus according to the present invention, the holder of the temperature detecting element is made of such a shape-memory alloys that, below the memory temperature, the state where the temperature detecting element is not in contact with the heat roller is maintained and that, above the memory temperature, the temperature detecting element will contact the heat roller to start carrying out the fixing pre-rotation of the heat roller.

Accordingly, since the temperature detecting element contacts the heat roller only when necessary for the temperature control of the heat roller, namely, since the contact period of the element with respect to the heat roller is short, damage of the heat roller is prevented and the longevity of the heat roller is improved.

Furthermore, since it is not necessary for the heat roller to get the fixing pre-rotation start timing thereof by a detection in which the thermistor always detects the surface temperature of the roller, it is unnecessary for the detectable region of the thermistor to be a very wide region from a high temperature to a lower temperature.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A fixing apparatus comprising:

a heat roller having a heater;

a pressure roller contacting said heat roller under pressure;

drive means for rotating said heat roller;

a temperature detecting element for detecting a temperature of said heat roller;

a holder holding said temperature detecting element to maintain said element out of contact with said heat roller when said heat roller is at a specified temperature or less and to maintain said element in a contact with said heat roller when said heat roller is above the specified temperature;

detecting means for detecting that said temperature detecting element contacts said heat roller; and control means for starting rotation of said heat roller in response to a signal from said detecting means.

2. A fixing apparatus as claimed in claim 1, wherein said holder contains shape memory alloys.

3. A fixing apparatus as claimed in claim 1, wherein a rotation of said heat roller is stopped when said temperature detecting element detects a specified temperature.

4. A fixing apparatus as claimed in claim 1, wherein said specified temperature is below a temperature at which a fixing operation can be carried out.

5. A fixing apparatus as claimed in claim 1, wherein said detecting means includes means for generating a signal at the time when said detecting means detects that an output generated from said temperature detecting element is greatly changed.

6. A fixing apparatus as claimed in claim 1, wherein said temperature detecting element has a negative temperatureresistance characteristic.

* * * * *